US009693916B2

(12) United States Patent
Dennis

(10) Patent No.: US 9,693,916 B2
(45) Date of Patent: Jul. 4, 2017

(54) ANTI-DECUBITUS ULCER MATTRESS OVERLAY SYSTEM WITH SELECTIVE ELEVATION STRUCTURE

(71) Applicant: Michael Dennis, Scappoose, OR (US)

(72) Inventor: Michael Dennis, Scappoose, OR (US)

( * ) Notice: Subject to any disclaimer, the term of this patent is extended or adjusted under 35 U.S.C. 154(b) by 294 days.

(21) Appl. No.: 14/515,085

(22) Filed: Oct. 15, 2014

(65) Prior Publication Data

US 2015/0026894 A1 Jan. 29, 2015

Related U.S. Application Data

(63) Continuation of application No. 13/647,328, filed on Oct. 8, 2012, now Pat. No. 8,898,842.

(60) Provisional application No. 61/545,137, filed on Oct. 8, 2011.

(51) Int. Cl.
*A47C 27/15* (2006.01)
*A61G 7/057* (2006.01)

(52) U.S. Cl.
CPC ..... *A61G 7/05715* (2013.01); *A47C 27/15* (2013.01)

(58) Field of Classification Search
CPC ..... A47C 27/15
USPC ..... 5/722, 728, 740, 652.1
See application file for complete search history.

(56) References Cited

U.S. PATENT DOCUMENTS 4,053,957 A * 10/1977 Regan ..... A47C 23/00 5/727
2011/0072589 A1* 3/2011 Dennis ..... A47C 27/14 5/691

* cited by examiner

*Primary Examiner* — Fredrick Conley
(74) *Attorney, Agent, or Firm* — Mohr Intellectual Property Law Solutions, PC

(57) ABSTRACT

An elevation structure system possesses anti-decubitus ulcer characteristics, and may cooperate with a mattress overlay also having anti-decubitus ulcer capabilities as part of a mattress overlay system, in which multiple elongate, positionally adjustable, relatively moveable risers are configured for selective placement in conditions of transverse, subposed, under-engagement with the sides of an overlay to create substantially non-inclined, elevated, depth-supplemented regions at locations along the length of the overlay. The elevation structure and overlay may each include a dynamic-response core expanse formed of an open-cell, compressible viscoelastic foam coated with an elastomeric, moisture- and gas-flow-managing, differential-thickness coating structure load-transmissively bonded to the entirety of the outside of said core expanse to function as a dynamically-responsive unit therewith.

18 Claims, 2 Drawing Sheets

ANTI-DECUBITUS ULCER MATTRESS OVERLAY SYSTEM WITH SELECTIVE ELEVATION STRUCTURE

RELATED APPLICATION

This application is a continuation of co-pending U.S. patent application Ser. No. 13/647,328, filed on Oct. 8, 2012. U.S. patent application Ser. No. 13/647,328 is an application claiming the benefit of U.S. Provisional Application No. 61/545,137, filed on Oct. 8, 2011. The entire disclosures of both of the above referenced patent applications are herein incorporated by reference for all purposes.

TECHNICAL FIELD

This disclosure relates to an anti-decubitus ulcer mattress overlay system featuring (a) an anatomical, pressure-evenizing mattress overlay having anti-decubitus ulcer characteristics, and (b) selectively cooperating elevation structure configured to be placed in conditions of transverse under-engagement in different locations relative to the overlay to create substantially non-inclined, elevated, depth-supplemented bands at locations along the length of the overlay, with the elevation structure also having anti-decubitus ulcer characteristics.

BACKGROUND

It has been recognized for some time that the medical issue involving the development of decubitus ulcers in bed-ridden patients, often those who are still in the environment of a hospital recovering from some medical event or condition, is a serious problem. Although there have been many approaches to solving this problem, many have shortcomings because they fail to grasp a full understanding of the key body-support and contact conditions that should exist if decubitus ulcer onset is to be reduced. In other words, prior art solutions are largely ineffective because they do not properly recognize, and address, the conditions under which decubitus ulcers develop.

Example embodiments of an effective anti-decubitus ulcer mattress overlay configured to function principally on the surface of a yieldable, underlying support structure, such as that furnished by a conventional hospital bed mattress, are provided in co-pending U.S. patent application Ser. No. 12/960,493, the entire disclosure of which is incorporated herein by reference for all purposes. The example mattress overlays disclosed therein possess various characteristics effective in reducing the possibility of decubitus ulcer onset (these characteristics are also referred to herein as "anti-decubitus ulcer characteristics"), such as (1) avoiding high, applied anatomical pressure and/or pressure-evenizing contact-loading characteristics defining how the anatomy of a bed-ridden patient is supported, (2) reducing friction and shear engagement between the overlay structure and a supported patient, (3) providing effective, ventilating, heat-removing, perspiration-managing, cooling airflow in the volumetric region disposed beneath the supported anatomy, such as to avoid overheating, and so forth.

There are circumstances, for example with regard to a bed-ridden, or otherwise long-term supported, patient, where it is important that some form of additional, anatomical underlying, full- or partial-width lateral support depth be provided, such as in order to elevate one or more portions of a patient's anatomy, for example to reduce swelling of an extremity and so forth.

While there are many approaches to accomplishing such an elevating function, such as, for example, employing a traction mechanism or the like to raise and suspendingly support a portion of a patient's body, employing one or more pillows or similar pads underneath a portion of a patient's anatomy, these measures may not be suitable for the handling of a patient where, as is now usually always the case, there is a concern that overpressure on the resting anatomy, even for relatively short periods of time, if sustained, may cause the onset of a decubitus ulcer.

SUMMARY

The present disclosure addresses the issues above by offering various embodiments of a mattress overlay system featuring a mattress overlay having anti-decubitus ulcer characteristics and an operatively associated elevation structure, which also possesses anti-decubitus ulcer characteristics, that is configured to be selectively placeable in conditions of transverse, subposed, under-engagement with the overlay to create substantially non-inclined, elevated, depth-supplemented regions at locations along the length of the overlay. In some embodiments, the anti-decubitus characteristics are achieved by both the overlay and the elevation structure having a similar core composition provided with a similar coating.

In some embodiments, the coating (of both the overlay and the elevation structure) in certain locations offers relatively free gas-breathability, and in other locations provides an impervious barrier to both gas and moisture.

In some embodiments, the core (of both the overlay and the elevation structure) includes a dynamic-response core expanse formed of an open-cell, compressible viscoelastic foam having a pre-stressed, partially compressed, relaxed-state volume to create a pre-compression condition, and an elastomeric, moisture- and gas-flow-managing, differential-thickness coating structure load-transmissively bonded to the entirety of the outside of the core expanse to function as a dynamically-responsive unit therewith, and possessing a relaxed-state, internal, pre-stressed tension condition, with the coating structure in some, respiration-window regions, being formed to be moisture-pervious and gas-permeable, and in other, non-respiration regions, being formed to be substantially moisture-impervious and gas-impermeable.

In some embodiments, portions of the coating structure of the system have an outer surface adapted to provide an interfacial stiction grip with other similarly-coated portions of the coating structure of the system, such as between the elevation structure and the lower face of the overlay when engaged.

In some embodiments, the elevation structure includes one or more elongate risers each having a length equal to or less than the width the overlay, a width equal to or less than approximately one-third the length of the overlay, and a constant thickness equal to or less than that of the overlay. In some of such embodiments, the risers define a constant rectangular cross-section along the length thereof. In some of such embodiments, the coating structure of each riser defines moisture-pervious, moisture-resistant, and gas-permeable sublayers enclosing the entirety of the outside of its core expanse, and a moisture-impervious and gas-impermeable outer layer interfacially bonded to the outermost sublayer enclosing only (and thereby defining) non-respiration regions. In some of such embodiments, the respiration regions are in the form of substantially rectangular respiration windows disposed, one-per-end, on opposed ends of each riser.

Various embodiments of an elevation structure system configured for use with an elongate anti-decubitus ulcer mattress overlay include elongate, positionally adjustable, relatively moveable, under-overlay elevation structure, such as multiple risers as briefly described herein.

The concepts, features, methods, and component configurations briefly described above are clarified with reference to the accompanying drawings and detailed description below.

DETAILED DESCRIPTION

Figure 1:
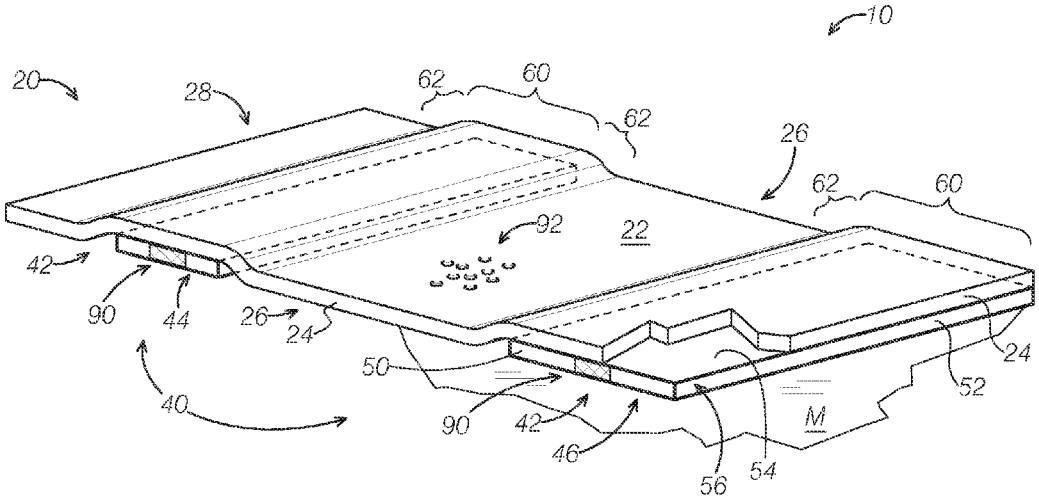
FIG. 1 is a simplified, isometric view of a mattress overlay system constructed in accordance with the present disclosure and including an anatomical, pressure-evenizing mattress overlay and operatively associated, positionally adjustable, relatively moveable under-overlay elevation structure in the form of two risers, or cushions, placed in a spaced, transversely oriented configuration of under-engagement with the overlay, with the system shown resting upon a fragmentarily shown hospital bed mattress.
Figure 2:
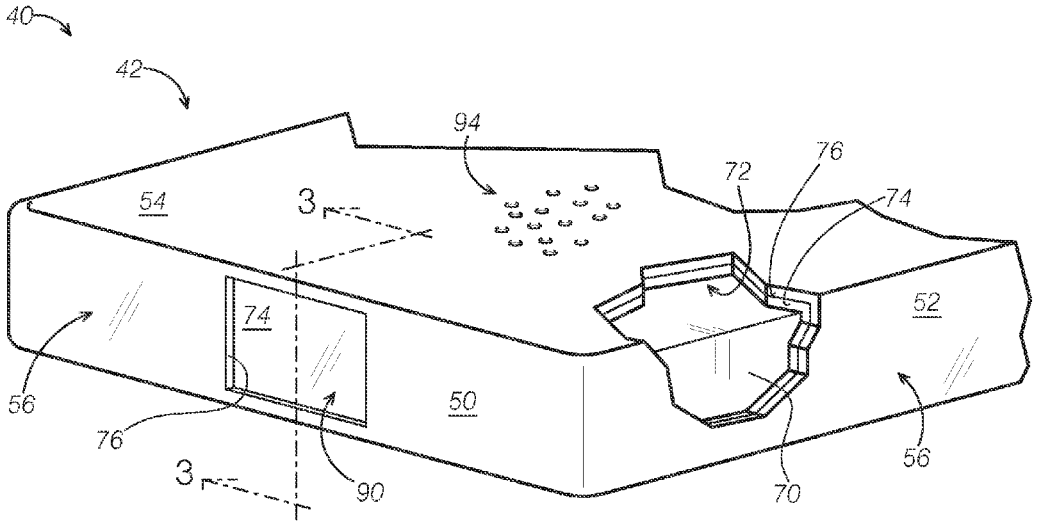
FIG. 2 is a simplified, isometric, and fragmentary view of one of the risers of the mattress overlay system of FIG. 1, shown in partial cutaway to reveal internal structure of the riser.

Referring to the drawings, a non-exclusive, example embodiment of an anti-decubitus ulcer mattress overlay system constructed and configured in accordance with the present disclosure is indicated generally at 10 shown in FIGS. 1-2, and is shown to include an elongate mattress overlay 20 and an operatively associated elevation structure 40, collectively and relatively positioned in the illustrated configuration on the surface of a hospital bed mattress of conventional construction shown generally, and fragmentarily, at M.

The components of the system 10 are not necessarily shown to proper proportion in the drawings, and the artisan will recognize that the dimensions of the overlay and/or the elevation structure may be modified to be suitable for a particular application, such as other environments involving convalescing patients (and that such modifications do not depart from the scope of the disclosure).

That being said, overlay 20 in the illustrated embodiment has a constant, overall thickness of approximately 1 inch, a lateral width of about 36 inches, and a length of about 75 inches, and thus approximates a rectangular cuboid in overall shape—as such, mattress overlay 20 defines upper and lower faces 22 spaced by a continuous perimetral edge 24, providing the overlay with sides 26 and ends 28. Further, elevation structure 40 in the illustrated embodiment is shown in the form of multiple elongate risers (also referred to herein as cushions) 42—particularly, a pair of spaced, transversely oriented (that is, relative to the long axis of the overlay) risers 44, 46—each of which also approximate the form of a rectangular cuboid having a length of about 36 inches, a thickness of approximately 1 inch, and widths of about 8 and 12 inches, respectively.

As such, each riser may be described as having a pair of opposed ends (or end faces, or end surfaces) 50, a pair of opposed sides (or side faces, or side surfaces) 52, and a constant rectangular cross-section along its length, and thus defining parallel upper and lower faces 54 spaced by a continuous perimetral edge 56.

It is due to the planar upper and lower faces of this rectangular volume—or, in a broader sense, it is due to the constant-thickness riser feature that in the illustrated embodiment is presented as an elongate, planar, rectangular riser volume—that the elevation structure 40 may be employed in associative cooperation with overlay 20 to create substantially non-inclined, elevated, depth-supplemented regions, or bands, at particular locations relative to the overlay. In FIG. 1, these depth-supplemented bands are indicated generally at 60, and typically approximate the size and shape of the corresponding riser 42 disposed in under-engagement with the overlay 20. In use, and depending on such factors as the relative flexibility of the overlay 20, its resting weight, the position of the elevation structure relative to the perimetral edge of the overlay 20, the thickness of the elevation structure, the arrangement of the anatomy of a patient supported by the overlay 20, and so forth, each substantially non-inclined, riser-undersupported band 60 will typically be associated with one or more at least partially-inclined, non-undersupported, perimetral regions (generally indicated at 62) where the lower face of the overlay ramps downward from the edge 56 of a riser 42 to the surface of the mattress M.

In the specific case of riser 46, which is placed in a condition of transverse, non-extendingly subposed under-engagement with overlay 20 with one of its side faces 52, and both of its end faces 50, aligned with the perimetral edge 24 of the overlay, riser-undersupported band 60 has one associated non-undersupported region 62, disposed proximate the opposed side face of the riser. The riser-undersupported band 60 created by riser 44, on the other hand, because this riser is placed inward from the end 28 of the overlay 20 (but with both of its end faces 50 aligned with the perimetral edge 24 of the overlay), is associated with two roughly parallel non-undersupported regions 62 disposed proximate the side faces of the riser 44.

Different positional configurations of risers 42 relative to the overlay 20 from those as shown may be selectively deployed to create different patterns of non-inclined, riser-undersupported bands (or other shapes) and/or partially-inclined, non-undersupported regions, as suitable to the nature of the patient's need or application at hand. For example, two or more risers may be stacked face-to-face, placed side-to-side (or end-to-end, or end-to-side), or spaced differently than as shown (in terms of distance between risers as well as relative transverse orientations thereof, such as parallel to each other or non-parallel), along one lateral side of the overlay and/or the other, in a completely and/or partly covered (or, put another way, non- or partially-extendingly subposed, respectively) relationship with the overlay, and so forth.

Further, a different number of risers than as shown may be included in elevation structures according to the present disclosures, having the same and/or different shapes, dimensions, and/or configurations than as shown. In product development and testing, it was found that risers in a size range having a length equal to or less than the width of the overlay, a width of no more than one-third of that of the overlay, and a constant thickness equal to or less than that of the overlay, were suitable for an extremely wide range of applications in which an elevating function is desired for an anti-decubitus ulcer mattress overlay. In example commercial embodiments, risers are available in two shapes of different sizes: a rectangular cuboid having dimensions of 8"×24"×1", and a square cuboid having dimensions of 20"×20"×1"; practitioners and medical personnel typically use one or more of the two commercially-available models in various configurations with an anti-decubitus ulcer overlay as described above, although other shapes and sizes are certainly within the scope of the present disclosure.

However, different dimensions than as shown and discussed, different elevation structure geometries, as well as a greater or lesser number of individual risers, risers with constant or non-constant cross-sections through their length, and so forth, may optionally be used to achieve a similar purpose. Such variations are considered to be well within the scope of this disclosure.

Whatever the actual configuration, the non-inclined geometry of the elevation structure provides the aforementioned elevating function, such as to provide one or more undersupported, depth-supplemented (or elevated) regions of elevated support for one or more anatomical portions of a bed-ridden patient.

However, it is important for the elevation structure to itself possess anti-decubitus ulcer characteristics similar to those provided by the overlay, for several reasons. For example, as explained below, some embodiments of the elevation structure are provided with a coating structure that provides an interfacial stiction grip, such as to prevent the elevation structure from migrating relative to the overlay from the position in which it is deployed; even so, inadvertent movement of the elevation structure, or even a deployed configuration in which one or more risers of the elevation structure is/are not completely subposed relative to the overlay, may expose a surface of the elevation structure that a supported patient may contact. As noted above, contact, and especially prolonged contact, with a support surface creates a risk of decubitus ulcer onset.

In another example, the above-cited U.S. patent application Ser. No. 12/960,493 explains that it is important, in order for the mattress overlay to perform correctly—or in other word to properly provide its anti-decubitus ulcer capabilities—that it be placed upon a yieldable surface (such as a hospital bed mattress); it is analogously important for the elevated regions (including the non-inclined, depth-supplemented regions 60 and any associated, partially-inclined, perimetral regions 62) of the overlay to be similarly, yieldably supported. In the case of non-undersupported, perimetral regions 62, such as those indicated in FIG. 1, and which correspond to one or both side edges 56 of a riser 42, the "yieldable support" is in the form of the tension inherent in the composition of the non-undersupported, suspended regions of the overlay itself, but in the riser-supported, depth-supplemented bands 60, the support is, of course, in the form of risers 42. As such, it is important that the risers provide this support yieldably, in a manner that that assists, or at least does not interfere with, the overlay in providing anti-decubitus ulcer characteristics. In other words, overfirmness or rigidity in the elevation-creating understructure will tend to defeat the anti-decubitus ulcer capabilities of a supported overlay.

To provide anti-decubitus ulcer characteristics that are similar to those of the overlay, embodiments of the systems disclosed herein include components (i.e., overlay and elevation structure) having similar, and in some cases identical, compositions.

In a general sense, and as is shown, for example, in FIG. 2, the elevation structure 40 (in the form of riser 42) is formed, basically, from two different components, or portions, including a single-piece, dynamic response core expanse, or core, and a differential-thickness coating, or coating structure. The core expanse of riser 42 is indicated generally at 70, and the coating structure is indicated generally at 72. As explained in greater detail in U.S. patent application Ser. No. 12/960,493, an anti-decubitus ulcer overlay has a similar construction. As such, the terms "core expanse" and "coating structure" (and alternative terms) are used herein, interchangeably in the singular and plural, to indicate that the feature or characteristic being discussed is common to both the overlay and the elevation structure; however, when discussing a characteristic or feature that may differ as between the overlay and elevation structure, the relevant term in the singular case (accompanied by a single reference number), is used.

That being said, the core expanse generally consists of an open-cell, compressible viscoelastic foam material, or materials, selected to have an internal structural character whereby, under changing compression-pressure conditions, it exhibits a compressive-deflection vs. compression-force (or load) curve that includes an extremely linear region over which a relatively wide change in compressive deflection is corresponds to an anatomically insignificant change in compression pressure, a feature that assists in providing evenized support pressure applied statically and dynamically to the underside of a supported anatomy. Example materials exhibiting such internal structure, and thus suitable for selection to form a core expanse of an overlay 20, are disclosed in U.S. patent application Ser. No. 12/960,493. Example materials suitable for selection to form core expanse 70 of elevation structure 40 (e.g., a riser 42) include product "B2670," available from IR Specialty Foam, LLC, of Fife, Wash. In some embodiments, the material(s) chosen for the core expanse of both components may have the same composition.

Whatever the material(s), the core expanse, within the structure of the overlay 20 and the elevation structure 40, is in a pre-stressed compressed condition, with a relaxed-state (that is, having no weight resting upon it) compression internally of approximately 8-10% in the embodiments discussed herein, brought about by virtue of the presence of allover coating provided by the coating structure, which in the illustrated embodiment is a multi-sublayered, sprayed-on, elastomeric vinyl coating prepared with a differential thickness—specifically, the coating structure is provided in two ranges of thickness, one in which the coating structure is moisture-pervious (but moisture-resistant) and gas-permeable, and one in which the coating structure is moisture-impervious and gas-impermeable. A vinyl material, such as that available as "Miraculon PDF-830" from PlastiDip International in Blaine, Minn., may be used to provide the coating structure, and when applied in a particular manner exhibits a controlled shrinkage responsible for placing the core expanse into nominal overall compression, and the coating structure into a nominal prestressed, tensed condition.

One example method of applying such a material to create a coating structure for an overlay, such as overlay 20, is described in U.S. patent application Ser. No. 12/960,493, and is suitable for coating both the overlay 20 and the elevation structure 40 of the present disclosure. As such, the full details of the method will not be repeated herein, but can be summarized with reference to FIG. 2, which in partial cutaway shows the aforementioned two-component composition of an example riser 42, and to FIGS. 3 and 4, which in two progressively more detailed cross-sections show an end face 50, and the region proximate thereto, of the example riser 42.

Figure 3:
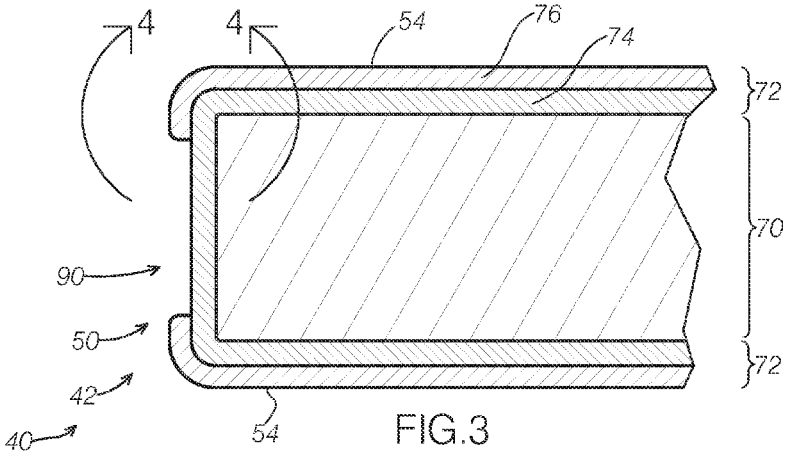
FIG. 3 is a fragmentary cross-sectional view taken generally along the line 3-3 of FIG. 2, showing an example configuration of the coating structure at, and proximate to, an end of the riser.
Figure 4:
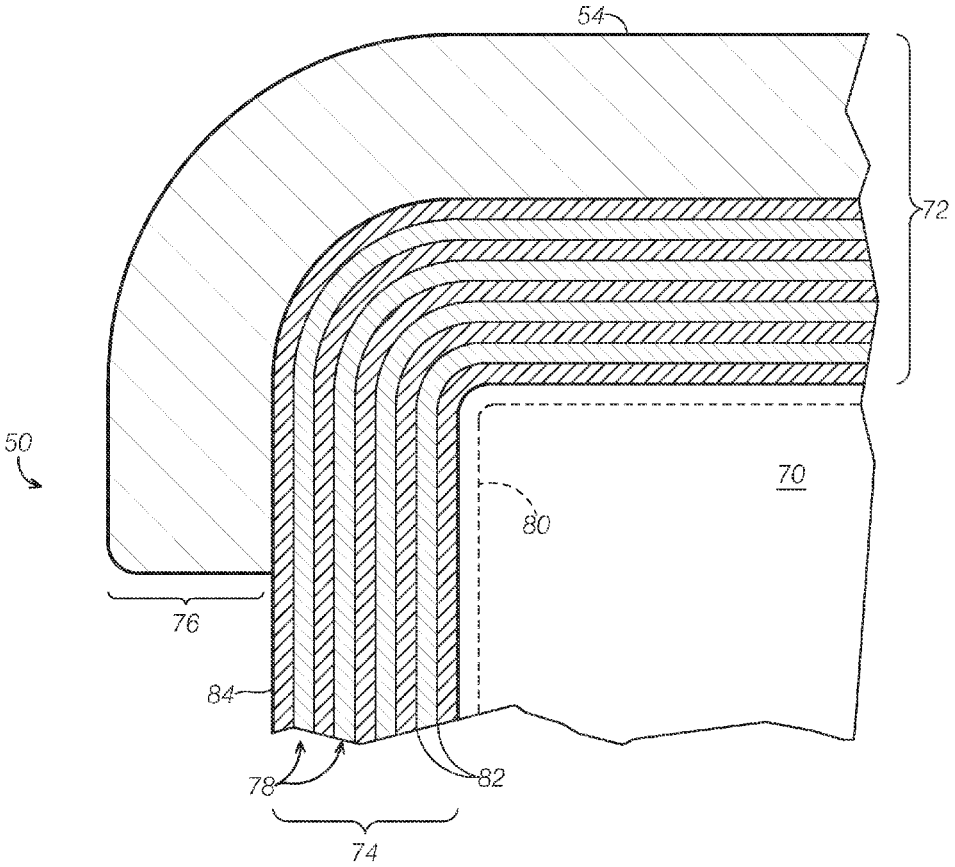
FIG. 4 is a larger-scale, fragmentary cross-sectional view of the region generally embraced by the two curved arrows 4-4 in FIG. 3.

In FIGS. 2 and 3, coating structure 72 is shown to include two more or less continuous (in terms of coverage of the core expanse) regions designated as an inner region 74 and an outer region 76, with inner region 74 shown in FIG. 4 to further consist of a plurality of sublayers 78. Outer region 76 consists of a single layer, and thus is also referred to herein as an "outer layer." Inner region 74 is load-transmissively (mechanically) bonded to core expanse 70, and outer region 76, when/where applied, is load-transmissively bonded to inner region 74.

Briefly, and with reference to FIG. 4, inner region 74 is formed by applying a sequence of individual sublayers 78 to core expanse 70, the first of which is a "primer" sublayer 80 (shown in dashed lines), which penetrates into the outer portion of the core expanse, and several thin, subsequently-applied "basic" sublayers 78, each joined to the next-adjacent sublayer through an initially-wet, interfacial surface of joinder, indicated at 82. The illustrated embodiment features about 10 sublayers each having a thickness of approximately 0.001 inch, and the resulting region 74 exhibits, by virtue of the material, method of application, and sublayer dimensions, moisture-resistant but moisture-pervious and gas-permeable characteristics.

Outer layer 76, as noted above, consists of a single layer of material applied to the outermost of the sublayers 78, indicated at 84, at a thickness selected to provide, on its own and/or in combination with underlying region 74, substantial moisture-imperviousness and gas-impermeability. In the illustrated embodiment—that is, employing the aforementioned vinyl material and applying it in the manner more thoroughly described in the aforementioned U.S. patent application Ser. No. 12/960,493—this thickness is approximately 0.01 inch, which is about equal to the combined thickness of the sublayers 78 of inner region 74.

As such, the selective application of outer layer 76 to outer sublayer 84 during manufacture allows the creation of respiration-window regions (or respiration windows), to provide free breathability to—that is, air- and fluid-flow into and out of—the core expanse of the riser in a controlled fashion, in terms of the arrangement of one or more respiration windows throughout the entirety of an otherwise fluid-tight coating structure.

Although different arrangements of respiration windows are possible and within the scope of this disclosure, the elevation structure 40 of the illustrated embodiment is provided with respiration windows, generally indicated at 90, located at either end 50 of each riser 42, and take the form of relatively small, rectangular windows, each formed in the surface of the perimetral edge 56.

With the brief summary of the method of application of the coating structure given above in mind, selective application of the outer layer 76 in a desired configuration may be achieved in any of a variety of manners, such as masking the areas or portions of the outermost sublayer 84 that are intended to become the respiration window(s) prior to applying the outer layer 76.

The disposition of the respiration windows 90 at the longitudinal ends 50 of the risers 42 illustrated herein is, at least in part, related to the function/placement of the various exterior surfaces of the risers when in use. When deployed, one of the broad, planar, upper and lower faces 54 typically contacts the underlying support structure (e.g., mattress IM), and the other contacts the underside of the overlay 20, and thus these faces 54 thereby may be considered to be "obstructed" by the surface with which the side surfaces are in contact. Further, one or both of the opposed side surfaces 52 may correspond to non-undersupported, perimetral regions 62 when deployed, and thus respiration windows disposed on such sides may be at least partially obstructed, for example due to the movement of position of supported anatomy. As such, in the case of an elongate riser 42, it may be most effective to place the respiration windows on the end surfaces 50 to reduce the possibility of obstruction.

Even in a configuration in which two risers 42 are placed end-to-end—wherein "end-to-end" means "with the surface of one end 50 placed in interfacial contact with the surface of another end 50"—fluid flow through the respiration window at the end that is not in contact with that of its neighbor is unobstructed.

As such, it is clear that elevation structures having different geometries than that of the illustrated embodiment may include a different arrangement of respiration windows and non-respiration regions than as shown and discussed herein, including configurations in which risers are provided with multiple respiration windows, such as disposed in several places along a perimetral edge, and so forth.

Again, all of such variations are considered to be within the scope of this disclosure.

Also, although not illustrated in the drawings, it will presumably always be the case (but not always so) that the mattress overlay 20 will also be provided with one or more respiration windows or like areas or regions in the coating structure thereof that are configured to selectively facilitate fluid flow management, the disposition, arrangement, composition, and/or other characteristics of which may be similar to or vary from those as shown with regard to respiration windows 90.

As explained in greater detail in U.S. patent application Ser. No. 12/960,493, the application process of the coating structure to the overlay—and specifically the curing step following the application of outermost layer—presents a special, exposed surface characteristic manifested in an overall distribution of extremely small, i.e., essentially microscopic, suction-cup-like indentations or dimples, which, when it rests upon a conventional hospital bed mattress cover, sticks to that cover, thereby resisting lateral slippage of the overlay relative to the mattress.

It has been found that surfaces provided with the aforementioned dimple distribution also exhibit similar suction-cup adhesion, or stiction, or a stiction grip, when placed in contact with each other. In other words, the stiction-providing surface condition cooperates with other surfaces possessing the same surface condition to prevent lateral relative slippage when engaged therewith.

The illustrated embodiment, accordingly, is provided with one or more outer surfaces adapted to provide the aforementioned interfacial stiction grip, such as an allover distribution of dimples on the overlay and the elevation structure. This surface condition is, for example, shown generally, schematically, and entirely out of scale in FIGS. 1 and 2, at 92 and 94, corresponding to the overlay 20 and elevation structure 40, respectively, which are in contact with each other in the illustrated, deployed arrangement of risers 42 under-engaging the lower face 22 of the of overlay 20. The provision of such a surface condition may be accomplished as noted above, that is, by virtue of the curing step following the application of the outermost layer of the coating structure on either or both the overlay and the elevation structure, or in any suitable manner.

Further, the disposition of the dimple distributions may be as desired—for example, in the illustrated embodiment, the entirety of the non-respiration region(s) of the coating structure (of both the overlay 20 and the elevation structure 40) is provided with stiction grip capability, which may allow great variation in positional adjustment of the elevation structure relative to the overlay while ensuring that, once deployed in a desired arrangement, the elevation structure will resist migrating from its position during use. Of course, other embodiments may include a combination of gripping surfaces and non-gripping surfaces, for example as a cue to the user that the system is to be used in a certain predetermined arrangement (or arrangements) and not in others, and so forth.

Although the present invention has been shown and described with reference to the foregoing operational principles and illustrated examples and embodiments, it will be apparent to those skilled in the art that various changes in form and detail may be made without departing from the spirit and scope of the invention. In one such example, an elevation structure system as described above is configured for use in cooperation with an elongate anti-decubitus ulcer mattress overlay having a different configuration than as discussed herein. The present invention is intended to embrace all such alternatives, modifications and variances that fall within the scope of the appended claims.

The invention claimed is:

1. A mattress overlay system, comprising:

an elongate mattress overlay having opposed sides and opposed ends defined by spaced upper and lower faces and a perimetral edge extending therebetween; and an operatively associated positionally adjustable, relatively moveable, under-overlay elevation structure configured to be selectively placeable in conditions of transverse under-engagement relative to the overlay between the opposed ends and sides thereof to create substantially non-inclined, elevated, depth-supplemented bands at locations along the length of the overlay;

wherein the elevation structure further comprises:

a dynamic-response core expanse formed of an open-cell, compressible viscoelastic foam having a pre-stressed, about 8-10% compressed, relaxed-state volume to create a pre-compression condition; and an elastomeric, moisture and gas-flow-managing, differential-thickness coating structure load-transmissively bonded to the entirety of the outside of said core expanse to function as a dynamically-responsive unit therewith, and possessing a relaxed-state, internal, pre-stressed tension condition, wherein the coating structure includes one or more respiration-window regions being formed to be moisture-pervious and gas-permeable, the respiration-window regions being surrounded by non-respiration regions being formed to be substantially moisture-impervious and gas-impermeable, and having an outer surface adapted to provide an interfacial stiction grip between the lower face of the overlay and the elevation structure when engaged.

2. The mattress overlay system of claim 1:

wherein the overlay defines a substantially constant width and thickness along its length; and wherein the elevation structure includes one or more elongate risers each having a length not greater than the width of the overlay, a width not greater than approximately one-third the length of the overlay, and a constant thickness not grater than that of the overlay.

3. The mattress overlay system of claim 2, wherein each riser defines a constant rectangular cross-section along the length thereof.

4. The mattress overlay system of claim 2, wherein each riser has a length substantially equal to the width of the overlay.

5. The mattress overlay system of claim 4, wherein each riser has a thickness substantially equal to that of the overlay.

6. The mattress overlay system of claim 4, wherein the one or more risers include two risers of identical thickness and length, deployable in a substantially planar orientation transverse to the long axis of the overlay either in a stacked or in a spaced configuration under one or more lateral regions of the overlay to correspondingly create one or more of said depth-supplemented bands thereat.

7. The mattress overlay system of claim 6, wherein the two risers define different widths.

8. The mattress overlay system of claim 2:

wherein each riser defines upper and lower faces spaced by a perimetral edge; and wherein the outer surface of the coating structure portions corresponding to at least the lower face of the overlay and one or both faces of each riser is provided with said interfacial-stiction-grip textural characteristic.

9. The mattress overlay system of claim 8, wherein said interfacial-stiction-grip textural characteristic is provided by means of an allover distribution of suction-cup-like dimples of said coating structure portions.

10. The mattress overlay system of claim 1:

wherein the elevation structure includes at least one riser having upper and lower faces spaced by a perimetral edge; and wherein said coating structure of each riser provides one or more of said moisture-pervious, gas-permeable respiration-window regions at one or more locations on said perimetral edge.

11. The mattress overlay system of claim 10:

wherein said perimetral edge of each riser defines parallel pairs of ends and sides thereof; and wherein one or more of said respiration-window regions are disposed, one each, on one or both ends of each riser.

12. The mattress overlay system of claim 10, wherein said coating structure of each riser defines one or more moisture-pervious, moisture-resistant, and gas-permeable sublayers enclosing the entirety of the outside of said core expanse, and a moisture-impervious and gas-impermeable outer layer interfacially bonded to the outermost sublayer enclosing only the non-respiration regions.

13. The mattress overlay system of claim 12:

wherein each of said sublayers and the outer layer includes the same material composition;

wherein each sublayer has a thickness of approximately 0.001 inch and is joined to the next-adjacent sublayer through an initially-wet, interfacial surface of joinder; and wherein the outer layer is applied at a thickness selected to provide substantially moisture-impervious and gas-impermeable characteristics.

14. The mattress overlay system of claim 1, wherein said viscoelastic foam exhibits a compressive-deflection vs. compression-force curve that includes a linear region over which a relatively wide change in compressive deflection corresponds to an anatomically insignificant change in compression pressure.

15. An elevation structure system configured for use in cooperation with an elongate anti-decubitus ulcer mattress overlay having sides, ends, and an outer surface, the elevation structure system comprising:

positionally adjustable, relatively moveable, under-overlay elevation structure configured to be selectively placeable in conditions of transverse under-engagement relative to the overlay between the opposed ends and sides thereof to create substantially non-inclined, elevated, depth-supplemented bands at locations along the length of the overlay, the elevation structure having a construction comprising:

a dynamic-response core expanse formed of a compressible material having a pre-compression condition therein; and an elastomeric, moisture- and gas-flow-managing, differential-thickness coating structure load-transmissively bonded to the entirety of the outside of said core expanse to function as a dynamically-responsive unit therewith, wherein the coating structure includes one or more respiration-window regions being formed to be moisture-pervious and gas-permeable, the respiration-window regions being surrounded by non-respiration regions being formed to be substantially moisture-impervious and gas-impermeable.

16. The elevation structure system of claim 15:

wherein the elevation structure includes one or more elongate risers each having a constant length equal to or less than the width of the overlay, a constant width equal to or less than approximately one-third the length of the overlay, and a constant thickness equal to or less than that of the overlay; and wherein each riser includes upper and lower faces spaced by a perimetral edge defining opposed pairs of ends and sides, with said moisture-pervious, gas-permeable respiration-window regions disposed, one each, on one or both ends of each riser, and with one or more continuous, substantially moisture-impervious and gas-impermeable non-respiration regions disposed on the entirety of the outer surface of each riser except for said one or more respiration-window regions.

17. The elevation structure system of claim 16:

wherein said coating structure of each riser defines one or more moisture-pervious, moisture-resistant, and gas-permeable sublayers enclosing the entirety of the outside of said core expanse, and a moisture-impervious and gas-impermeable outer layer interfacially bonded to the outermost sublayer enclosing only the non-respiration regions;

wherein each of said sublayers and the outer layer includes the same material composition; and wherein the outer layer is applied at a thickness selected to provide substantially moisture-impervious and gas-impermeable characteristics.

18. The elevation structure system of claim 16, wherein the one or more elongate risers include two elongate risers of identical thickness and length, deployable in a substantially planar orientation transverse to a longitudinal axis of the overlay with the opposed ends thereof non-extendingly subposed relative to the sides of the overlay, either in a stacked or in a spaced, parallel configuration under one or more lateral regions of the overlay to correspondingly create one or more of said depth-supplemented bands thereat.

* * * * *